United States Patent [19]

Dondeyne et al.

[11] 4,193,355

[45] Mar. 18, 1980

[54] FURNACE WALLS WHICH CAN BE USED AT HIGH TEMPERATURES

[75] Inventors: Alban Dondeyne, Chatenay Malabry; Maurice Marchasson, Douai; Paul Ravez, Flers-en-Escrebieux; Louis Soubrier, Douai, all of France

[73] Assignee: Houilleres du Bassin du Nord et du Pas de Calais, Douai, France

[21] Appl. No.: 897,487

[22] Filed: Apr. 18, 1978

[30] Foreign Application Priority Data

Apr. 18, 1977 [FR] France ..... 77 25313

[51] Int. Cl.[2] ..... F23M 5/04

[52] U.S. Cl. ..... 110/336; 432/238

[58] Field of Search ..... 110/336, 337; 432/252, 432/238; 202/223, 267, 268

[56] References Cited

U.S. PATENT DOCUMENTS

| | | | |
|---|---|---|---|
| 2,141,035 | 12/1938 | Daniels | 202/223 |
| 2,548,485 | 4/1951 | Lubbock | 432/238 |
| 3,197,385 | 7/1965 | Wethly | 202/268 |
| 3,378,247 | 4/1968 | Pullen et al. | 432/238 |
| 3,652,070 | 3/1972 | Sagara | 432/238 |
| 4,003,696 | 1/1977 | Rolla | 432/238 |

*Primary Examiner*—Edward G. Favors

*Attorney, Agent, or Firm*—Bacon & Thomas

[57] ABSTRACT

The present invention relates to new furnace walls comprising recesses for the introduction of fluids, characterized in that they comprise:

a strong refractory material, a shield of refractory metallic material, supports, plates of disposable material anchorable to the said supports, and, in the recesses, devices for introduction and distribution of fluids, the said walls being particularly utilizable for furnaces which operate at an internal temperature of at least 900° C.

8 Claims, 8 Drawing Figures

FURNACE WALLS WHICH CAN BE USED AT HIGH TEMPERATURES

The present invention relates to treatment furnaces which operate at temperatures at least 900° C. and which have walls resistant to such temperatures, and also have tubes through which fluids necessary for heating the said furnaces are distributed through the said furnaces.

The walls of industrial furnaces in which reactions at high temperatures have to be carried out may, a priori, be produced from the following materials:

Refractory steel, provided the temperature of the oven remains below 900° C., refractory ceramic materials, such as siliceous refractory bricks or silico-aluminous bricks with a greater or lesser content of alumina, and refractory concretes, and electro-fused materials if it is necessary to obtain temperatures above 1,500° C.

Refractory ceramic materials and electro-fused materials are all more or less sensitive to thermal shocks, that is to say to rapid temperature variations of a certain amplitude. On the other hand, all of these materials contain, to varying degrees, a vitreous phase which, at the temperatures in question and under certain treatment conditions, tends to cause similar materials which may be present in the mass of the products to be treated, to become bonded to the wall material. This means that precautions have to be taken in carrying out chemical reactions which take place in the said furnaces so as to avoid the refractory ceramic materials or electro-fused materials from cracking as well as to avoid the walls becoming lined with fused products. Furthermore, repairs of such refractory materials are difficult and always expensive.

It is known, furthermore, that refractory metal alloys exhibit certain advantages, at least up to a working temperature of about 900° C.; beyond this temperature, though the surface condition of these alloys remains suitable up to about 1,200° C., the mechanical strength of the alloys decreases more or less rapidly depending on the varieties employed, so that they can no longer be subjected to substantial stresses.

Furthermore, it has been found that the fusible phases of the products being treated attach themselves to the surfaces of these alloys without this anchoring causing a intimate association with the alloy.

In addition, in numerous furnaces operating at high temperatures it is necessary to introduce and distribute fluids required for heating these furnaces; these fluids are, for example, fuels, other combustible materials, combustion products or mixtures of these various fluids. The introduction of these fluids presents a certain number of problems associated with non-uniform variations in the dimensions of the tubes which introduce the fluids and which are subjected to high temperatures.

In order to minimise these difficulties it has already been proposed to set the said tubes in recesses formed in the walls of the furnace; this arrangement offers the essential advantage of leaving the total volume of the furnace free, but it also suffers from the disadvantage of increasing the problems associated with the differences in temperature between the parts of the tubes which face the inside of the furnace and the parts of the tubes which face the wall.

The present invention relates to a construction of a furnace wall which allows working at temperatures above 900° C. and has recesses through which the tubes for the introduction of fluids which require to be distributed in the furnace pass, the said wall being characterised in that it comprises:

a mineral refractory material chosen from amongst ceramic materials and electro-fused materials, the said refractory material forming the load bearing part of the wall;

a shield of a refractory metallic alloy which lines the surface of the wall with refractory material;

supports joined to the said refractory metallic shield, or consisting of a shaped portion of the refractory material; and plates of a disposable material resistant to heat and to abrasion and anchorable to the said supports;

the said wall comprising, between the disposable plates, recesses through which pass devices for the introduction of fluids, the said devices consisting of an internal tube and an external tube connected so that the stresses generated on the external tube are not transmitted to the internal tube.

The wall according to the invention can furthermore be characterised in that a thin layer of a refractory insulating material, preferably of a silico-aluminous substance, which lines the surface of the mineral refractory material, is provided between the mineral refractory material and the metallic alloy shield.

The new walls according to the invention can be used for producing all or part of the walls of a furnace in question; they can, for example, form the external walls of a furnace or the dividing walls between two furnaces.

The plates of disposable material which form the internal lining of the furnaces are easily replaceable by identical prefabricated plates. Since furthermore the covering or coverings of refractory material which lines or line the surface of the refractory material forming the mechaically resistant part of the wall protects or protect this latter material from thermal shocks, it will be seen that shut-downs for repairing furnaces produced according to the invention are as short as possible.

Furthermore, these disposable plates can be of such size as to cover as large a part as possible of the internal surface of the furnace in the useful zone, taking into account, of course, the various devices with which the said furnace must be equipped. They can in particular be used to protect, at least partly, the tubes or conduits which pass through the hot part of the furnace and which could be subjected to premature erosion or abrasion because of the presence of moving solid particles in the furnace.

These tubes or conduits are in fact located in the recesses produced in the wall of the furnace; however, even using such an arrangement it has been found that the said tubes underwent very substantial deformations. To avoid these deformations, it has been found that the said tubes should consist, inside the furnace, of an internal tube through which the gaseous fluid is introduced and an external tube which surrounds and protects the internal tube.

Thus, according to this device the fluid introduced through the internal tube passes through the external tube before being distributed through the furnace; thus this device furthermore makes it possible to use one of the tubes (the internal tube) for the purpose of introducing the fluid, and the other tube (external tube) for the purpose of suitably distributing the fluid through the furnace.

The external tube is so arranged and constructed that the stresses and deformations to which it may be subjected cannot have significant effects on the internal tube, and for this purpose it is possible to use various known solutions for joining these two tubes, such as, for example, the use of expansion bellows, of thin deformable members or of expansion joints.

Finally, it has been found that the external tubes can be of such shape and occupy such a position that they can, together with the plates of disposable material, form a virtually planar and continuous wall. Thus, for example, these tubes or conduits can have a rectangular cross-section possessing a planar external face, which is located in the same plane as the free face of the plates of disposable material. Such an arrangement is of a type which avoids the existence of localised eddies in the furnace and which avoids the bonding of molten products, which may be present in the said furnace, to the surface of the said tubes or conduits.

Examples of embodiments of the invention are given below with reference to FIGS. 1 to 8.

Figure 1:
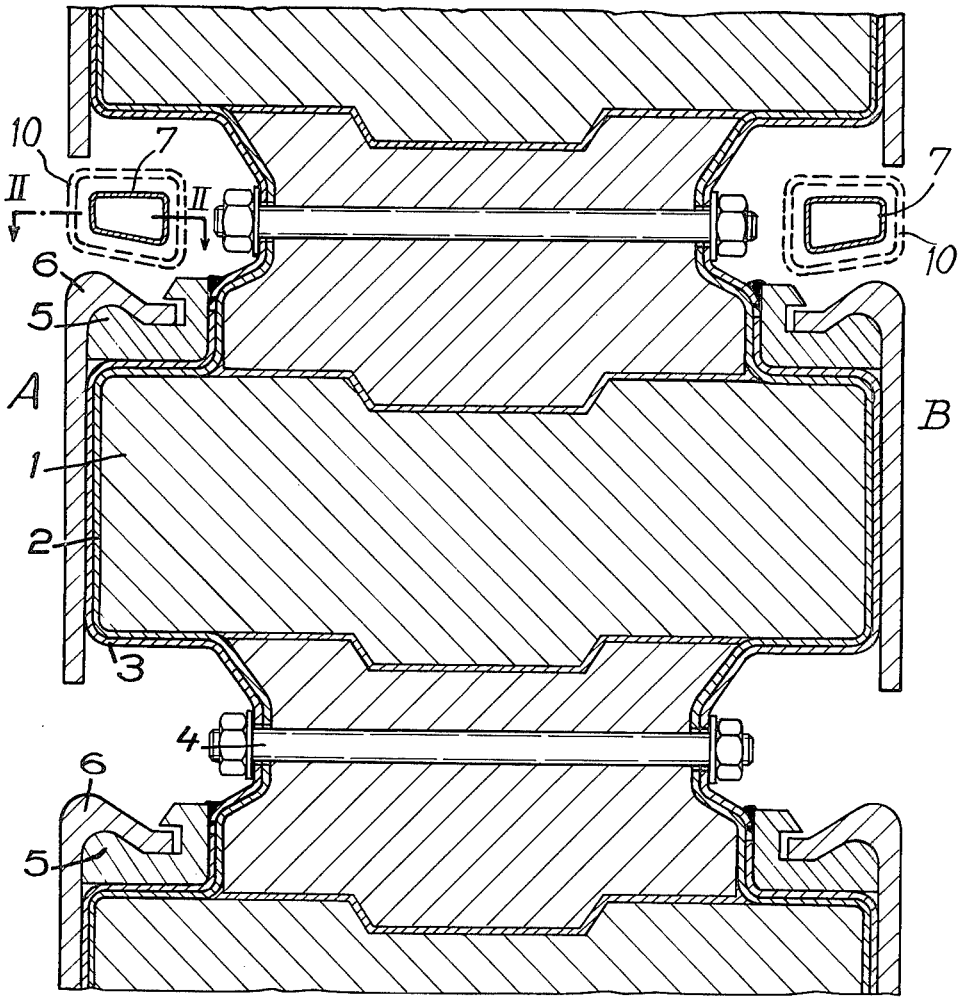
FIG. 1 represents, in cross-section, a dividing wall between two furnaces A and B.
Figure 2:
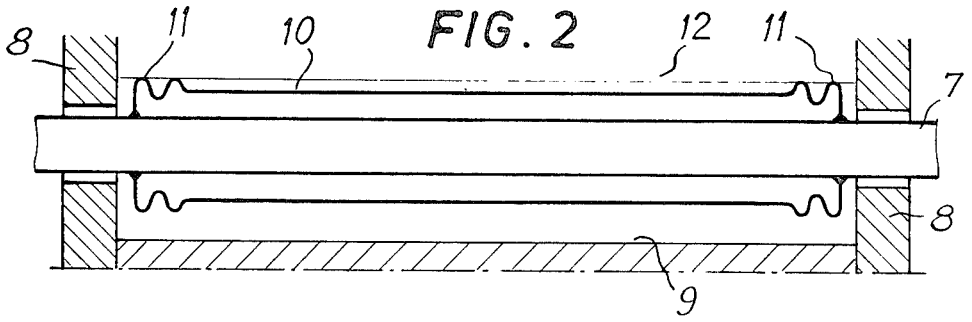
FIGS. 2 to 8 represent in cross-section (along II, II), with greater detail, various arrangements of the tubes, for the introduction of fluid, in the seats of the wall, the said seats and the said wall being shown schematically.

In FIG. 1 are shown:

at 1, the mechanically resistant refractory material produced, for example, of silico-aluminous bricks, at 2, a layer of refractory insulating material which lines the two surfaces of the refractory material; preferably, a felt or a board consisting of kaolin-based fibres is chosen for this insulating material, at 3, a shield of refractory metallic alloy which in turn lines the refractory insulating material 2. In the schematic arrangement, the two materials 2 and 3 are held in place, at the surface of the central refractory material, by means of a threaded rod 4 provided with washers and nuts at its ends, the said threaded rod being made, for example, of a refractory metallic alloy.

at 5, anchoring members, made of a refractory metallic alloy, which are suitably positioned and welded onto the shield below them and at 6, disposable cladding members, made of a refractory metallic alloy, which are simply hooked onto the anchoring members 5.

This same figure shows tubes 7 which can be used for introducing air or for circulating various fluids, in a recess formed by the internal wall of the furnace. As can be seen, the disposable cladding members partly protect the said tubes.

FIG. 2 shows:

at 8, the end walls of the furnace, and at 9, the base of a recess formed in the wall of the furnace, this recess containing the device 7 for the introduction and distribution of the fluids.

The device 7 is formed of an internal tube around which is fixed an external tube 10; the bond between tubes 10 and 7 is effected by means of expansion bellows 11.

The fluid is passed through the tube 7, issues through orifices of this tube and enters the external tube 10 from which it issues towards the interior 12 of the furnace.

Different constructions of the two tubes may also be used.

Figure 3:
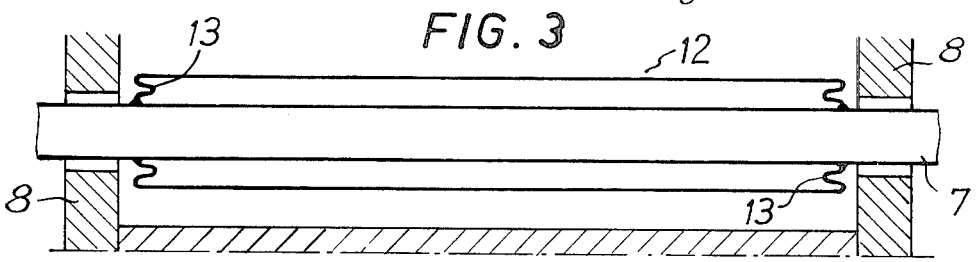

Thus, the internal and external tubes can be joined by means of deformable thin metallic members located at the two ends of the external tube; this has been shown schematically in FIG. 3, where the thin members are shown at 13.

Figure 4:
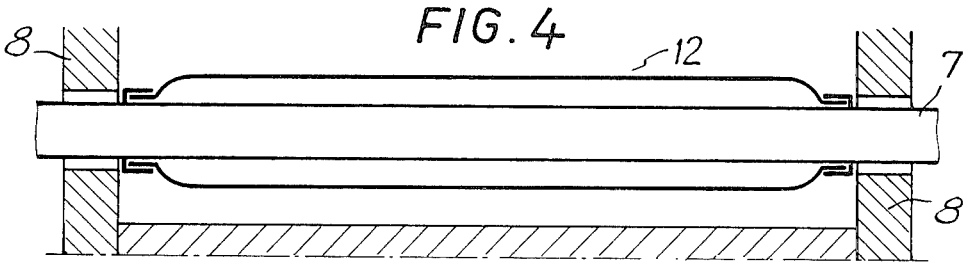

It is also possible to provide a flexible connection between the two tubes in accordance with a method of assembly shown schematically in FIG. 4; of course, a suitable gasket (for example asbestos) is fixed at the junction points between the tube.

Figure 5:
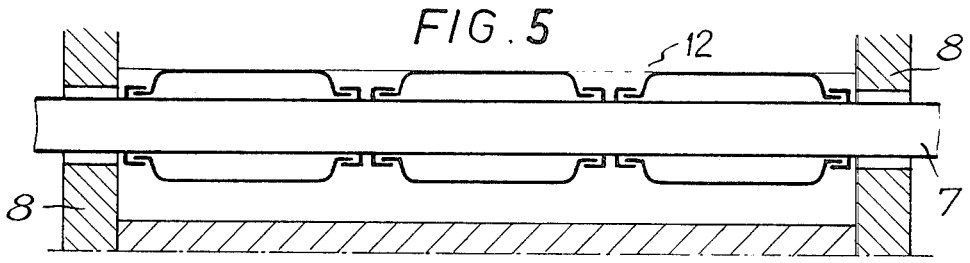

It is also possible to use several short external tubes which may or may not be connected to one another and are mounted on the same internal tube; this is shown schematically in FIG. 5.

Figure 6:
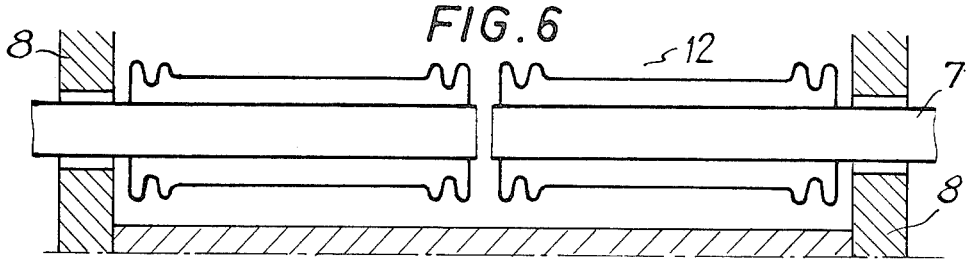

It is also possible to use two internal tubes mounted end to end, with the adjacent ends closed off; this is shown schematically in FIG. 6. It is interesting to note the following with regard to this figure; if the orifices in the internal tube which allow the fluid to pass from the internal tube to the external tube are located near the central part of the furnace (which in the present case means near the blocked ends of the internal tubes), a maximum amount of fluid will flow through virtually the whole of the said internal tube. Suitable distribtion of the said fluid in the furnace is achieved by means of orifices, of suitable position and size, in the sole external tube.

If the function of introducing the fluid into the furnace and the function of distributing this fluid within the furnace are thus separated, greater uniformity of the temperature of the internal tube can be achieved; furthermore, this tube can remain at a relatively low and uniform temperature by virtue of various coverings, such as various insulating coverings, which can even be rigid, for example made of ceramic materials, which coverings can be located on the outside or inside of the said tube.

It is also possible, in order to provide even better rigidity of the internal tube, to envisage placing this tube under slight tension, (for example by means of springs); the tension applied must of course be compatible with the strength of the said tube at the temperature at which it is operating. This application of tension is particularly useful if the furnaces have very long walls, for example greater than 3 meters.

In the embodiment according to the invention, the external tube can undergo certain deformations; however these are relatively limited because these deformations essentially occurs at the deformation joints located at the ends of the said tube; it is for this reason that it has been found that, if necessary, the external tube can also be lined internally with refractory materials, even rigid materials such as, for example, ceramic materials.

In a simplified variant of the devices, the internal tube is used for introducing the fluid and for distributing it in the furnace.

This tube is preferably thermally insulated on the outside by a flexible refractory material.

The external tube is replaced by pieces of short length surrounding the tube for the introduction of fluid and referred to below as discs even though their shape need not necessarily be cylindrical. These discs are preferably separated from one another by gaskets of lesser thickness, consisting of a refractor material having a degree of elasticity.

Of course, the discs located in line with the orifices for injection into the furnace are hollowed-out over the part located in register with the said orifices.

The assembly is held by stops fixed onto the tube for introducing the gases and located towards each end of the said tube.

In a variant of this simplified device, the pieces surrounding the tube for the introduction of the fluid are hollowed-out to leave a free space around the tube for the introduction of the fluids.

Transverse movement of the discs relative to the fluid-introducing tube is avoided by any appropriate means such as projections, and the like.

Figure 7:
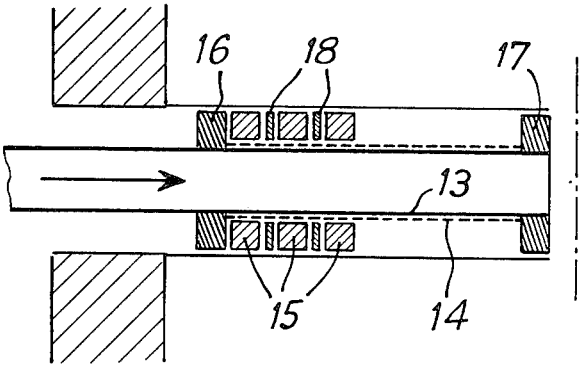

A device according to the invention, comprising an internal tube for the introduction of fluids and discs as the external tube, is shown in FIG. 7.

In this figure may be seen an internal tube (13) closed at one of its ends and surrounded by an insulating material (14). Around this tube are placed discs (15) held between two stops (16 and 17). Gaskets (18) have been placed between the discs.

Figure 8:
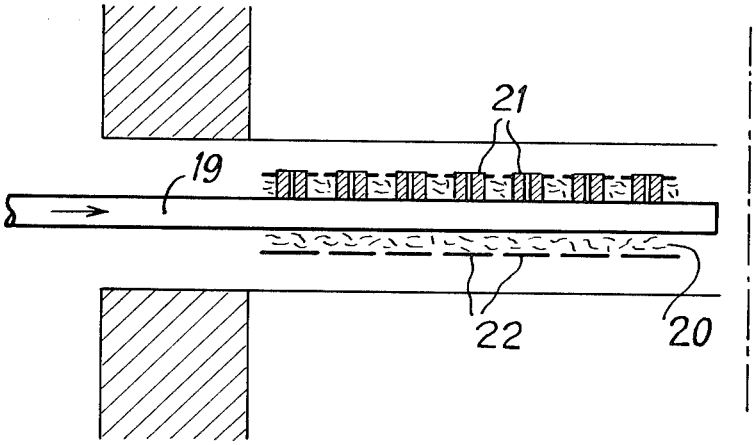

In a variant of this latter device, the internal tube is also used for the introduction of the fluid and its distribution in the furnace (FIG. 8).

The tube (19) is thermally insulated on the outside, for example by a flexible refractory material (20).

The fluid is distributed through nozzles (21) which pass through the insulating material.

The insulating material and the internal tube are protected by pieces of short length (22) which may or may not be cylindrical, and are fixed to the nozzles (21) or held in position. These protective pieces can either have sufficient play between them or be separated by gaskets so that they can deform without significant effect on the internal tube and on its refractory covering.

Though the new walls according to the invention can be used in numerous furnaces, it has been found that they are more particularly of value for constructing furnaces intended for carrying out oxidation reactions or coking of coals or of agglomerates based on carbonaceous materials.

What is claimed is:

1. A furnace wall for furnaces working at temperatures above 900° C. and having recesses through which pass tubes for the introduction of fluids to be distributed in the furnace, characterized in that it comprises:

a mineral refractory material chosen from amongst ceramic materials and electro-fused materials, the said refractory material forming the load-bearing part of the wall;

a shield of a refractory metallic alloy which lines the surface of the wall with refractory material;

support means for anchoring a shield to said refractory material;

a shield comprising plates of a disposable material resistant to heat and to abrasion and anchorable to the said support means;

the said wall defining, between the disposable plates, said recesses and tube assemblies in said recesses for the introduction and distribution of fluids, the said tube assemblies consisting of an internal tube and an external tube connected so that the stresses generated on the external tube are not transmitted to the internal tube.

2. A wall according to claim 1, characterised in that it comprises a thin layer of refractory insulating material of a silico-aluminous type, between the said refractory material and the said metallic alloy shield.

3. A wall according to one of claims 1 or 2, characterised in that the support means and the plates of disposable material consist of refractory metallic alloy.

4. A wall according to claim 1, characterised in that the external tube consists of several tubes independent of one another.

5. A wall according to claim 1, characterised in that at least one of the said tubes is provided with an insulating material.

6. A wall according to claim 5, characterised in that the internal tube is externally equipped with an insulating material and internally equipped with a material of a ceramic type.

7. A wall according to claim 5, characterised in that the external tube is internally provided with a material of a ceramic type.

8. A wall according to claim 1, characterised in that the internal tube is held under tension.

* * * * *